US007328743B2

(12) United States Patent
Turta et al.

(10) Patent No.: US 7,328,743 B2
(45) Date of Patent: Feb. 12, 2008

(54) TOE-TO-HEEL WATERFLOODING WITH PROGRESSIVE BLOCKAGE OF THE TOE REGION

(75) Inventors: Alex Turta, Calgary (CA); Fred Wassmuth, Calgary (CA); Vijay Shrivastava, Calgary (CA); Ashok Singhal, Calgary (CA)

(73) Assignee: Alberta Research Council, Inc., Edmonton, Alberta (CA)

( * ) Notice: Subject to any disclaimer, the term of this patent is extended or adjusted under 35 U.S.C. 154(b) by 0 days.

(21) Appl. No.: 11/534,542

(22) Filed: Sep. 22, 2006

(65) Prior Publication Data

US 2007/0068674 A1 Mar. 29, 2007

Related U.S. Application Data

(63) Continuation of application No. PCT/CA2006/000327, filed on Mar. 9, 2006.

(60) Provisional application No. 60/719,901, filed on Sep. 23, 2005.

(51) Int. Cl.

| | |
|---|---|
| ***E21B 33/138*** | (2006.01) |
| ***E21B 43/20*** | (2006.01) |
| ***E21B 43/22*** | (2006.01) |
| ***E21B 43/30*** | (2006.01) |

(52) U.S. Cl. ..... 166/245; 166/50; 166/270; 166/295

(58) Field of Classification Search ..... 166/50
See application file for complete search history.

(56) References Cited

U.S. PATENT DOCUMENTS 2,281,801 A * 5/1942 Reynolds et al. ..... 166/306
3,349,844 A * 10/1967 Rhea et al. ..... 166/252.1
3,713,489 A * 1/1973 Fast et al. ..... 166/292

(Continued)

FOREIGN PATENT DOCUMENTS

RU 2208147 7/2003

(Continued)

OTHER PUBLICATIONS

Bailey, B., Crabtree, M., Tyrie, J., Elphick, J. Kuchuk, F., Romano, C. and Roodhart, L. "Water control." Oilfield Review Spring 2000, pp. 30-51.

(Continued)

*Primary Examiner*—George Suchfield
(74) *Attorney, Agent, or Firm*—Greenlee, Winner and Sullivan, P.C.

(57) ABSTRACT

A modified toe-to-heel waterflooding (TTHW) process is provided for recovering oil from a reservoir in an underground formation. After establishing the conventional TTHW waterflood, the process includes placing a chemical blocking agent at the watered out producing toe portion of the horizontal leg of the production well to create a blockage in the producing toe portion and to create a new producing toe portion in an open portion of the horizontal leg adjacent the blockage through which most of the production takes place. Production is then continued through the new producing toe portion and the open portion of the horizontal leg of the production well. These blocking and producing steps can be continued to progressively block producing toe portions in a direction toward the vertical pilot portion of the production well.

13 Claims, 10 Drawing Sheets

U.S. PATENT DOCUMENTS

| | | | | | |
|---|---|---|---|---|---|
| 4,147,211 | A | * | 4/1979 | Sandiford | 166/270 |
| 4,227,743 | A | * | 10/1980 | Ruzin et al. | 299/2 |
| 4,299,284 | A | * | 11/1981 | Brown et al. | 166/245 |
| 4,384,579 | A | * | 5/1983 | Lucas | 604/135 |
| 4,460,044 | A | * | 7/1984 | Porter | 166/252.1 |
| 4,662,449 | A | * | 5/1987 | Friedman | 166/295 |
| 4,682,652 | A | * | 7/1987 | Huang et al. | 166/272.3 |
| 4,683,949 | A | * | 8/1987 | Sydansk et al. | 166/270 |
| 4,705,109 | A | * | 11/1987 | Ledent et al. | 166/251.1 |
| 4,722,397 | A | | 2/1988 | Sydansk et al. | |
| 4,842,068 | A | * | 6/1989 | Vercaemer et al. | 166/269 |
| 4,928,763 | A | * | 5/1990 | Falk | 166/285 |
| 4,951,751 | A | * | 8/1990 | Jennings, Jr. | 166/285 |
| 5,030,036 | A | | 7/1991 | Huff et al. | |
| 5,042,581 | A | | 8/1991 | Jennings et al. | |
| 5,207,271 | A | * | 5/1993 | Sanchez et al. | 166/281 |
| 5,314,019 | A | * | 5/1994 | Honarpour | 166/270 |
| 5,353,874 | A | * | 10/1994 | Manulik | 166/281 |
| 5,375,661 | A | | 12/1994 | Daneshy et al. | |
| 5,425,421 | A | * | 6/1995 | Coleman et al. | 166/250.14 |
| 5,486,312 | A | | 1/1996 | Sandiford et al. | |
| 5,626,191 | A | | 5/1997 | Greaves et al. | |
| 5,697,441 | A | * | 12/1997 | Vercaemer et al. | 166/285 |
| 5,884,701 | A | * | 3/1999 | Von Plahn | 166/279 |
| 6,047,773 | A | * | 4/2000 | Zeltmann et al. | 166/281 |
| 6,167,966 | B1 | | 1/2001 | Ayasse | |
| 6,186,231 | B1 | * | 2/2001 | Kalfoglou | 166/270 |
| 6,367,548 | B1 | * | 4/2002 | Purvis et al. | 166/281 |
| 6,412,557 | B1 | | 7/2002 | Ayasse et al. | |
| 6,497,290 | B1 | | 12/2002 | Misselbrook et al. | |
| 6,533,038 | B2 | | 3/2003 | Venning et al. | |
| 6,619,397 | B2 | | 9/2003 | Coon et al. | |
| 6,712,154 | B2 | | 3/2004 | Cook et al. | |
| 6,766,858 | B2 | | 7/2004 | Nguyen et al. | |
| 7,069,990 | B1 | * | 7/2006 | Bilak | 166/271 |
| 7,225,689 | B2 | * | 6/2007 | Wickstead et al. | 73/863.23 |
| 2001/0045280 | A1 | * | 11/2001 | Longbottom et al. | 166/271 |
| 2003/0015325 | A1 | | 1/2003 | Vienot | |

FOREIGN PATENT DOCUMENTS

| | | |
|---|---|---|
| WO | WO 96/16248 | 5/1996 |
| WO | WO 01/94742 | 12/2001 |
| WO | WO 2005/035936 | 4/2005 |
| WO | WO 2006/029510 | 3/2006 |

OTHER PUBLICATIONS

Denys, K. and Zaitoun, A. "Briding absorption of catonic polyacrylamides in SiC packs." Institut Francais du Petrole.

Schlumberger (Jul. 2002) "Water solutions."

Seright et al. (www.pttc.org accessed May 4, 2005) "Polymer and polymer-gel water shutoff treatments. What it takes to be successful and illustrative field application," based on a workshop held on Aug. 25, 2004.

Kabir, A.H. (2001) "Chemical Water and Gas Shutoff Technology—An Overview," Paper SPE 72119, Presented at SPE Asia Pacific Improved Oil Recovery Conference, Oct. 6-9, 2001, Kuala Lumpur, Malaysia.

Seright, R.S. (Nov. 1995) "Gel Placement in Fractured Systems," *SPE Production and Facilities* 10(4):241-248.

* cited by examiner

TOE-TO-HEEL WATERFLOODING WITH PROGRESSIVE BLOCKAGE OF THE TOE REGION

CROSS REFERENCE TO RELATED APPLICATIONS

This application is a Continuation of International Application No. PCT/CA2006/000327, filed Mar. 9, 2006, which claims priority from U.S. Provisional Patent Application No. 60/719,901, filed Sep. 23, 2005.

FIELD OF THE INVENTION

The invention relates to an improved Toe-to-Heel Waterflooding (TTHW) process for the recovery of oil from an underground oil reservoir.

BACKGROUND OF THE INVENTION

The Toe to Heel Waterflooding (TTHW) process is described in U.S. Pat. No. 6,167,966, issued Jan. 2, 2001 to the same assignee as the present case. Briefly, the TTHW consists of guiding the advance of a liquid displacement front originating from an injection well by having a production well with an open horizontal leg oriented towards the injection well act as a linear pressure sink to which the front is attracted and by which the front is guided. The present invention is directed to the problem of watering out or coning associated with continued production during the TTHW process, after initial production occurs at the "toe" of the horizontal leg of the production well.

Irrespective of whether premature water break-through in a horizontal well is coming from a coning situation in a reservoir with bottom water, or from a waterflood operation, the zonal isolation and blocking of a portion of the reservoir through which water is coning is a very complex and costly operation which generally involves the following steps or operations. Firstly, identifying the "culprit/offending" zone and secondly, isolating the zone by some kind of blockage. The identification of the "offending zone" is usually made with a production logging operation.

For both heavy and light oil reservoirs with large thickness and high permeability, or even for low permeability reservoirs (if they have a streak of high permeability at the bottom or if horizontal permeability increases downwards), the TTHW process, which in the field takes the name of "water injection at the toe", seems to be very efficient, and is currently undergoing field testing. For intermediate and heavy oil reservoirs, the application of TTHW is almost a requirement, as it entails a short-distance oil displacement, as compared to the long-distance displacement in the conventional waterflooding. Conventional waterflooding in heavy oil reservoirs is associated with either very large pressure gradients or premature water break-through, and both these aspects lead to low injectivity or poor sweep efficiency, and result in poor oil recovery. In the scenarios mentioned above TTHW is a process leading to a better sweep efficiency and hence higher oil recovery.

The TTHW process disclosed in U.S. Pat. No. 6,167,966 involves providing one or more water injection wells completed low in the reservoir, and one or more production well having a horizontal leg completed high in the reservoir. The horizontal leg is oriented toward the injection well, with its toe close to the injection well. In a preferred embodiment, water injection is started at the injection well(s) and a laterally extending, quasi-upright waterflood front is advanced toward the horizontal production well. The production well is kept open and continuously produces oil, creating a linear, low pressure sink. The sink acts to attract and guide the advance of the laterally extending front along its length. It has been found that the waterflood front will stay quasi-upright and its direction of advance is controlled to yield good vertical and lateral sweep. This embodiment is referred as the single-stage version of the TTHW process.

SUMMARY OF THE INVENTION

The improvement in the TTHW oil recovery process provided by this invention includes progressive blockage of the toe region of the horizontal leg of the production well. Increasing and successive portions of the horizontal leg of the production well adjacent to the toe are blocked, such that only the remaining portion of the horizontal leg, closer to the heel, is open for oil production. This progressive blockage of the toe region results in reduced water cuts and improved oil recovery in comparison to the single stage TTHW process described above.

The technical problem to be solved with the known single-stage version of the TTHW process is as follows:

a) if one or more vertical injection wells are completed low in an oil-containing reservoir and a production well, having a horizontal leg, is completed relatively high in the reservoir, the horizontal leg being oriented toward the injection well so that the leg lies in the path of a displacement front emanating from the injection well(s); and
b) if a generally linear, laterally extending and quasi-upright water displacement front is established and propagated in the reservoir using a staggered line drive configuration;
c) then the horizontal leg, which is at low pressure (normally achieved by keeping the production well open), provides a low pressure sink and outlet that functions to induce the front to advance in a guided manner first toward the "toe" and then along the length of the leg to the "heel"; and
d) in the conditions set out above, the "watering out" of the horizontal leg takes place first at the toe and then progresses toward the heel; specifically, the water cut per unit (m) of perforations decreases substantially from the toe to the heel.

After a period of production as set forth in step c above, in accordance with the present invention, the TTHW process is modified when the producing toe portion of the horizontal leg of the production well is chemically blocked, and only the remaining portion, heel-adjacent region (termed the new producing toe portion) is left open to oil production. This step of blocking can be repeated as the new producing toe becomes watered out in order to progressively block producing toe portions toward the heel of the production well. This modified process, with a progressive series of blockages is found to result in a decrease in current water cut and an increase of ultimate oil recovery. The process can be repeated until blockage of the horizontal leg has progressed back to the pilot hole of the horizontal well, which is open for production. When the water cut at the pilot hole increases to a high value (say about 90-95%), then the pilot hole well can be converted to a water injection well, the former water injection well can be shut-in; and a new horizontal well located in a next nearest row can be opened for production.

The present invention is applicable to the single-stage version of the basic TTHW process as described in U.S. Pat. No. 6,167,966. The process of this invention has similarities to the single-stage version of the basic TTHW process. These processes share the scheme of using an open (continuously producing) horizontal well to create a linear low pressure sink for guiding an oil displacement front. However, they differ in other important respects, and the innovations introduced in this invention lead to improved oil recovery. Although the injection well(s) are basically the same in both cases, the present invention differs in being based on the horizontal production well having different completions during the operation, and using different operating constraints to achieve improved oil recovery. These new completions introduce a series of progressive blockages in the horizontal leg, with the creation of a "new producing toe portion" after each blockage operation. Unlike the situation for conventional blockage operations performed in horizontal producers which are used in waterflood operations, blockage in accordance with the present invention can be done without first performing a production logging operation for the detection of the "offending zone", since the next section to be blocked is the watered out "toe" region.

The present invention is generally not applicable to the two-stage version of the TTHW process, as described in U.S. Pat. No. 6,167,966, in which a water blanket at the bottom of the formation is initially created by keeping open the pilot-hole of the producer while its horizontal leg is closed, and then the pilot hole is closed and the horizontal leg is opened. Additionally, the present invention is generally not applicable to reservoirs with an initial gas cap or having a thief zone mini-layer at the top of formation.

Broadly stated, the present invention provides a process for recovering oil from a reservoir in an underground formation, comprising:

a) providing a vertical injection well completed in the lower part of the reservoir, or a horizontal injection well located and completed in the lower part of the reservoir, and a production well having a generally vertical pilot portion and a generally horizontal leg which is completed relatively high in the reservoir and oriented toward the completed part of the injection well;

b) injecting a liquid heavier than oil into the reservoir through the injection well to establish a body of said liquid low in the reservoir and underlying the horizontal leg of the production well;

c) continuing to inject liquid with the production well open, so that oil is produced through the horizontal leg, and the leg creates a low pressure sink which causes a displacement front to advance either or both laterally and upwardly through the reservoir toward the horizontal leg, thereby driving oil through the horizontal leg of the production well, the open portion of the horizontal leg at which most of the production takes place being termed the producing toe portion of the horizontal leg;

d) after a time, placing a chemical blocking agent at the producing toe portion of the horizontal leg of the production well to create a blockage in the producing toe portion and to create a new producing toe portion in the open portion of the horizontal leg adjacent to the blockage, through which production may take place;

e) continuing production through the new producing toe portion and the open portion of the horizontal leg of the production well; and f) optionally repeating steps d) and e) to progressively block producing toe portions in a direction toward the pilot portion of the production well.

Blocking in accordance with the invention is preferably achieved by:

i) shutting in the production well;

ii) providing coil tubing through the production well to reach the producing toe portion to be blocked;

iii) optionally, but preferably, injecting a protection fluid into an annulus formed in the horizontal leg around the coil tubing which is not to be blocked;

iv) injecting a chemical blocking agent through the coil tubing in a volume greater than that needed to fill the producing toe portion to be blocked;

v) removing the coil tubing and allowing the chemical blocking agent to set to create the blockage in the producing toe portion; and vi) resuming production at the new producing toe portion and the open portion of the horizontal leg of the production well.

In a preferred embodiment of the process, after injecting the chemical blocking agent, a more robust chemical blocking agent, for example a reinforced gel such as a sandy gelant material, is injected into the producing toe portion, thereby pushing the chemical blocking agent into the reservoir surrounding the producing toe portion to be blocked.

The process of the present invention has important advantages compared to prior art recovery processes for a similar reservoir, including a decrease in current water cut, an increase of ultimate oil recovery, and the avoidance of having to perform production logging to find the "offending" zone for blocking.

"Horizontal leg of either a production or injection well" as used herein and in the claims, means a well drilled generally horizontally along the bedding plane, although it may have some undulations, within the limits of drilling precision.

The "toe" of the horizontal leg of the production well is the end of the horizontal production well closest to the injection well, while the "heel" is the end of the horizontal production well most distant from the injection well.

"Oriented toward" as used herein and in the claims to describe the orientation of the horizontal leg of the production well relative to the injection well, is not limited to a trajectory directly at the injection well. Rather the term includes well placements (whether a single or plurality of wells are involved) designed to result in the displacement front from an injection well (vertical or horizontal) reaching the toe portion of the horizontal leg of a production well in the desired toe-to-heel order.

DESCRIPTION OF THE PREFERRED EMBODIMENTS

Figure 1:
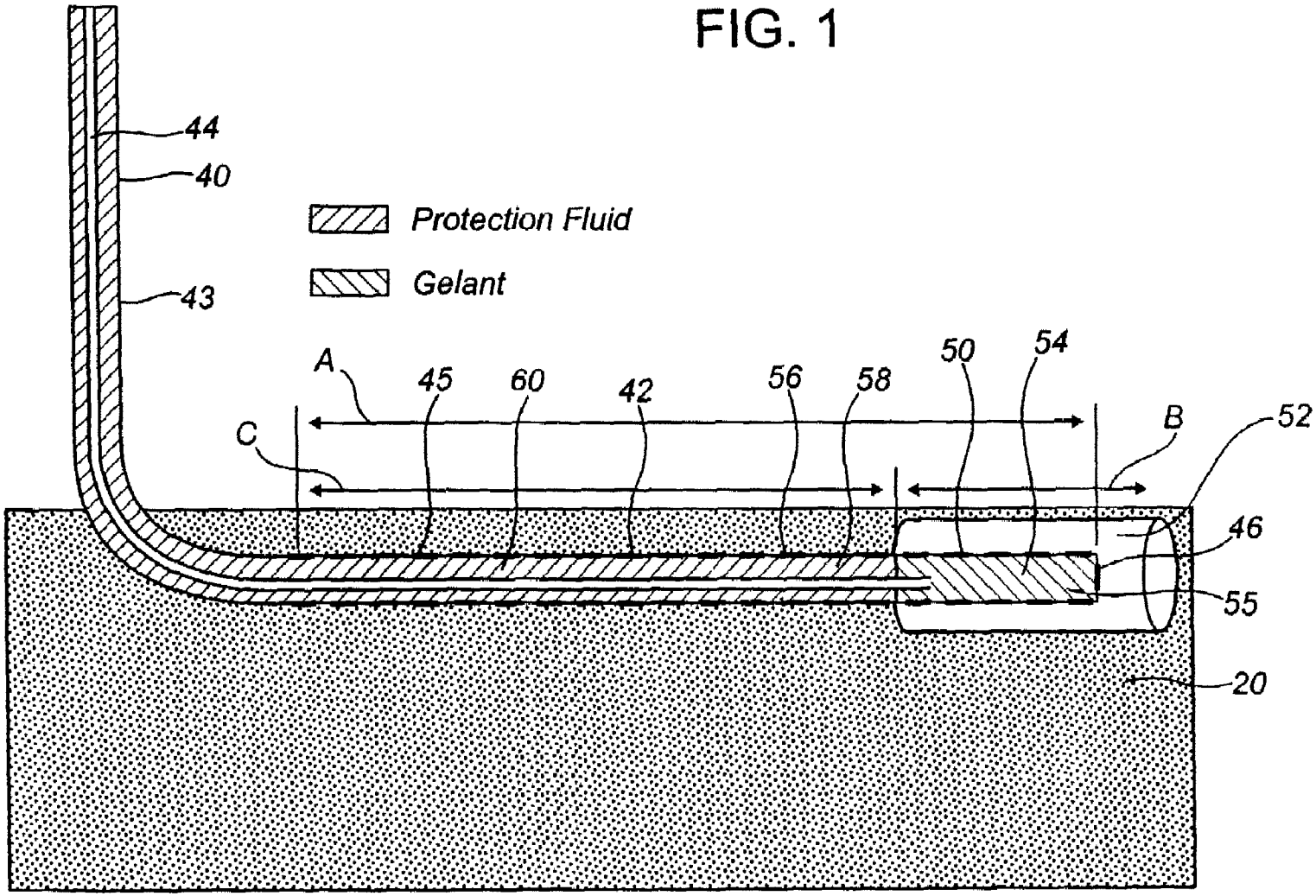
FIG. 1 is a schematic sectional view showing the coil tubing approach to selectively block the producing toe portion of the horizontal leg of the production well, once the water cut from that area is too high.
Figure 2:
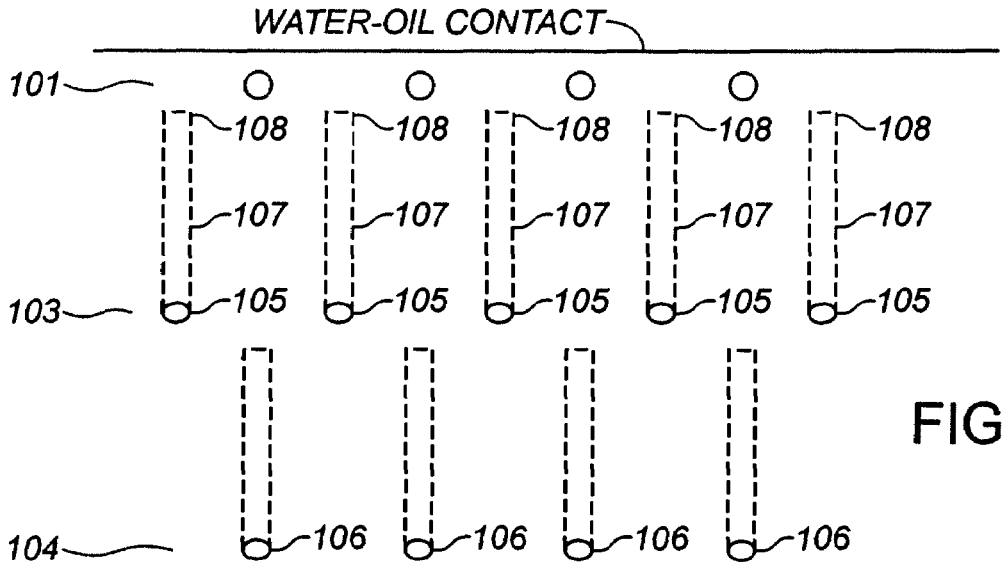
FIG. 2 is a schematic plan view showing the proposed well pattern arrangement for utilizing the invention while using vertical wells as initial injectors.
Figure 3:
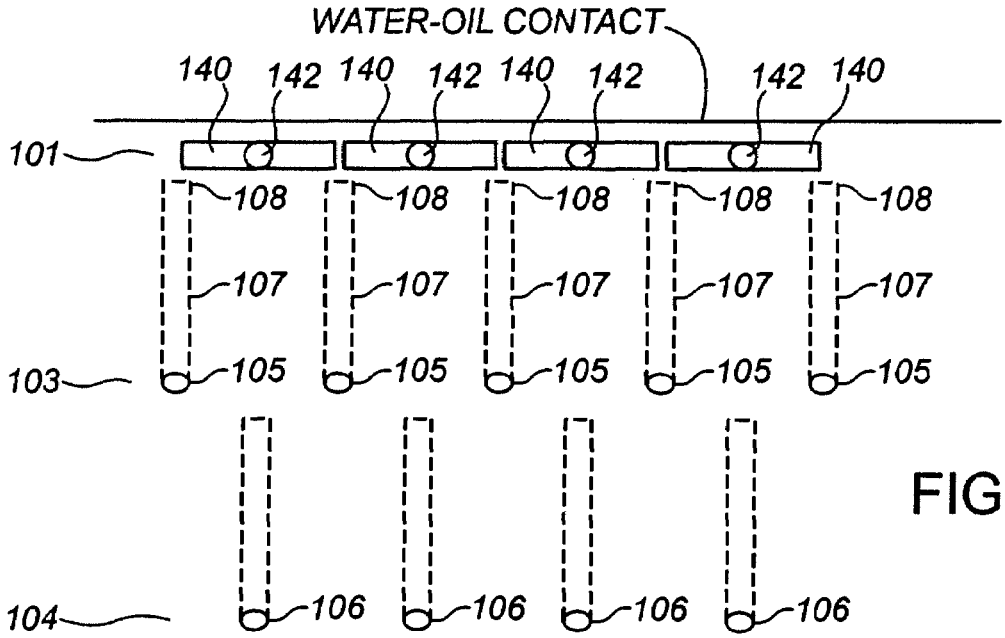
FIG. 3 is a schematic plan view showing the proposed well pattern arrangement for utilizing the invention while using horizontal wells as initial injectors.

In the process of the present invention, establishing the wells, completing the wells and the initial stages of TTHW waterflooding and production at the toe of the horizontal leg of the production well is in accordance with known prior art techniques. With respect to the initial stages of the TTHW, the details are in accordance with the single stage process of TTHW waterflood as set forth in U.S. Pat. No. 6,167,966. Generally, additives may be added to the waterflood, as is known in the art.

Progressive blocking in accordance with the present invention is commenced at a time after initial waterflooding. In general, blocking is considered once the water cut becomes uneconomically high at the producing toe portion of the horizontal leg of the production well, such as greater than 90%.

Chemical Blocking of Producing Toe Portion of Horizontal Production Well

Water shutoff methods of the prior art can be divided into chemical and mechanical techniques. Mechanical techniques such as packers and bridge plugs, which can be used to isolate watered out sections in a wellbore, often require ideal wellbore conditions. Mechanical blocking techniques are often impractical in horizontal wells, as the productive sections are usually open hole and may include slotted liners. Cased horizontal wells are not the norm, so the use of mechanical isolation tools becomes unreliable.

In the present invention, the method for water shutoff in the producing toe portion of the horizontal well is through the use of chemical blocking agents. Chemical blocking agents are described generally in the prior art, see for instance "Chemical Water & Gas Shutoff Technology—An Overview", A. H. Kabir, Petronas Carigali Sdn. Bhd., SPE Asia Pacific Improved Oil Recovery Conference, 6-9 Oct. 2001, Kuala Lumpur, Malaysia. The numerous chemical materials which can be used as chemical blocking agents generally fall into three categories: cements, resins, and gels.

1. Cements have excellent mechanical strength and good thermal stability, but cements do not readily penetrate into tight areas.

2. Resins can penetrate into rock matrix and tight areas. Resin mechanical strength depends on the resin's formulation. However, resins are usually more costly to apply.

3. Gels can also penetrate into rock matrix and tight areas. Gels generally include as starting materials a polymer and a cross-linker. A gel for blocking in the process of the present invention should preferably meet the following criteria: a) the gel should be capable of being placed at an appropriate location in order to perform the blocking function; b) the resulting gel plug should have sufficient strength to withstand formation pressure; c) the gel and its use should be relatively low cost, compatible with downhole conditions, and environmentally acceptable; and d) it should be comprised of starting materials having controllable rate of setting or gelation to provide a desired working time. The strength of a resulting gel plug is dependent on the composition of the gel. In order to be effective, the gel plug should have enough strength to withstand the pressure gradients experienced along the horizontal wellbore. Suitable and exemplary gels are described in, for example, "Conformance improvement in a subterranean hydrocarbon-bearing formation using a polymer gel", U.S. Pat. No. 4,683,949 Sydansk et al., Aug. 4, 1987, and "Well completion process using a polymer gel", U.S. Pat. No. 4,722,397 Sydansk, et al. Feb. 2, 1988. Exemplary gels are those comprised of a solution comprising a polyacrylamide and a cross-linker, such as for example a MARCIT™ or a MARA-SEAL™ gel developed by Marathon Oil Corporation. The MARCIT gel is comprised of a relatively high molecular weight polyacrylamide gelling agent. The MARA-SEAL gel is comprised of a relatively low molecular weight polyacrylamide gelling agent. Where the gel includes a cross-linker, any cross-linker which suitable for use with the gelling agent may be used. With polyacrylamide polymers, the cross-linker may, for example, be comprised of chromium acetate.

As set out herein, it may be preferable to use a more robust chemical blocking agent, sometimes called a reinforced gel, such as a sandy gel, to block the wellbore portion of the producing toe. Most prior art work on water shut-off and reservoir conformance control treatments using polymer gels have been conducted on porous media. Some work has been done on blocking fractures, see for example, Seright, R. S. "Gel Placement in Fractured Systems", SPE Production and Facilities, 241-248, November 1995. However, given the large diameter of the wellbore to be blocked in this invention, compared to porous medium or fracture widths, polymer gels without reinforcing materials may tend to form a weak blockage. A more robust chemical blocking agent has an increased mechanical strength achieved by concentrating the formulation or through the addition of solids to the formulation to produce, for example, sandy gel materials. Exemplary sandy gel materials (also termed reinforced gels) are described in, for example, PCT Patent Application No. PCT/CA2005/001389, filed Sep. 13, 2005, published as WO 2006/029510 on Mar. 23, 2006, and titled "Method for Controlling Water Influx into Wellbores by Blocking High Permeability Channels", inventors Bernard Tremblay et al. When using a robust gel or reinforced gel, it may be comprised of the same or different gel as the unreinforced gel, but will preferably be the same (see preferred gels and cross-linker systems described above). The reinforcing material used to reinforce the gel may be any suitable natural or synthetic particles or fibers having relatively fine particle size to minimize settling out from the gel. Preferably, the reinforcing material is one or more of sand, gravel or crushed rock. Following addition of the reinforcing material, the reinforced gel should have sufficient injectivity to be capable of being injected into the toe region of the horizontal leg through coil tubing.

Gel formulations can be adjusted to provide high thermal stability, see for example "High Temperature Stable Gels", U.S. Pat. No. 5,486,312 Sandiford et al. Jan. 23, 1996. In addition, gels are usually more economical and practical to apply than are other chemical blocking agents.

Even though each of the above listed materials can be used as chemical blocking agents in the present invention, gels and/or reinforced gels are the preferred chemical blocking agents. These gels are commercially available, and typically the supplier provides a gel formulation suitable for injection and setting in the particular reservoir conditions at hand. The type of gel and the optimum formulation are dictated by the reservoir characteristics (temperature, permeability, degree of fracturing) and wellbore conditions.

To prepare the gel, the polymer gelling agent is hydrated to form a gelling agent solution, and then the cross-linker is added. When using a reinforced gel, after hydrating to form a gelling agent solution, the reinforcing material is added, and then the cross-linker is added. Preferably, for either the reinforced or unreinforced gel, the cross-linker is added just prior to injecting the gel in accordance with this invention.

"Gelant" or "Gel" as used interchangeably herein and in the claims include gels of fluid chemical formulation that can be injected through the wellbore into the formation, and then set into a rubbery gel within the formation. The gel formulation can be any commercial formulation with suitable characteristics, allowing the gel to first flow into the oil producing formation and then, after a setting period, block water from flowing into the wellbore. The gelation reaction needs to be suitably delayed to allow for the injection of the gel down the horizontal well and into the formation.

With reference to FIG. 1, an oil reservoir 20 is shown with a production well 40 having a horizontal leg portion 42 located relatively high in the reservoir 20, and a vertical section 43. The perforated section of the horizontal leg, for example a slotted liner, is shown as region A. In accordance with this invention, a gel is placed to block the toe section 46 of the horizontal leg 42 of the production well 40 by a multi-step process. The production well 40 is first shut in. Preferably, the injection well (not shown in FIG. 1, but see FIGS. 2 and 4*a*-4*g* where it is labeled 101) is also shut in. Coiled tubing 44 is placed down the vertical section 43 and the horizontal leg 42 of the production well 40 to reach the targeted toe portion to be blocked (region B) this being the producing toe portion which has watered out. The mixed, liquid gel is injected into the coil tubing 44 from the surface and is piped to the toe section of the horizontal well 40. At this point the gel leaves the tubing, spreads along the wellbore of the toe, and is squeezed into an area 52 of the oil reservoir 20. Subsequent to placing enough gel into the reservoir 20, a more robust gel formulation is preferably injected into an area 54 of the open wellbore section of the toe 55, to plug the wellbore proper. Gel formulations can be made more robust to withstand washout by increasing the concentration of the chemicals or through the addition of sand or fine solid materials to produce a material known as a sandy gel, as described above and in the above-identified PCT Application PCT/CA2005/001389.

At the end of the gel treatment, the gel or reinforced gel is preferably displaced out of the coiled tubing 44 in order to clear the coil tubing and to push the gel or reinforced gel into the toe portion to be blocked. A chaser fluid is used for this purpose. The chaser fluid may be any fluid capable of displacing the gel, provided it either does not interfere with the wellbore or may be flushed from the wellbore. The preferred chaser fluid is water, but produced water, formation water or brine might also be used. The coil tubing 44, once flushed is then removed.

The production well remains shut in for a sufficient time to allow for setting of the gel. The time will depend on the gel formulation. The time may vary from several days to weeks or even longer. In general, a set time of about 48 hours is usually sufficient. Production may then be resumed at the portion of the horizontal leg adjacent to the blocked region, now termed the new producing toe portion 56.

To prevent back flow of the gel along the annulus 58 between the coil tubing 44 and the horizontal leg wellbore (whether or not cased), a protection fluid 60 such as oil or water is preferably injected from the surface into this annulus 58, prior to the injection of the chemical blocking agent (see region C). The gel injection through the coiled tubing 44 should only commence when the protection fluid, flowing along the annulus 58, reaches the end of the coiled tubing 44 at the toe section of the wellbore 46. The protection fluid is preferably injected for the duration of the gel treatment. An advantage of using viscous oil as a protection fluid is that it does not leak-off into the formation as quickly as water and the relative oil permeability in the near wellbore region is not impaired. Thus, it is preferred to use viscous oil as a protection fluid. When injecting the protection fluid, the downhole pressure of the injected protection fluid should be equivalent to the pressure exerted by the gel exiting at the end of the tubing. With reference to FIG. 1, in order to confine the penetration of the chemical blocking agent within the portion of the horizontal well targeted for blocking, a continuously injected protection fluid prevents the injected gel from penetrating into the annulus 58 and behind the perforated liner 45 in the new producing toe region 56 adjacent the blocked former toe region.

Sizing of the gel treatment is based on geometric considerations. For example, if approximately 100 m of the producing toe portion is to be blocked and the gel penetrates into the reservoir for a 1 m radius, then the required gel volume can be calculated as follows, using an example of one reservoir and well size:

Porosity=0.3, Wellbore radius=0.1 m

Gel Volume in Reservoir=
$(\pi*(1\ m)^2*100\ m)*0.3=94\ m^3$

Gel Volume in Wellbore=
$(\pi*(0.1\ m)^2*100\ m)=3.1\ m^3$.

In the example above, approximately 94 $m^3$ of gel would be placed in the reservoir and 3.1 $m^3$ of gel would be used to block the wellbore. Thus, for this example, the total gel treatment requires mixing on the surface and injecting into the reservoir approximately 97.1 $m^3$ of gel formulation.

An exemplary field embodiment of the progressive toe region blockage process of this invention is described in connection with FIGS. 2, 3, 4*a*-4*g*, which generally show an oil bearing reservoir 100 punctuated by injection wells 101 or 140 and production wells 103, 104 as described herein. The preferred well patterns or configuration for field applications of the present invention is described for the case of TTHW using either vertical injectors (FIG. 2 and 4*a*-4*g*) or horizontal injectors (FIG. 3), to initiate the process. In both cases, the staggered line drive is applied.

Figure 4A:
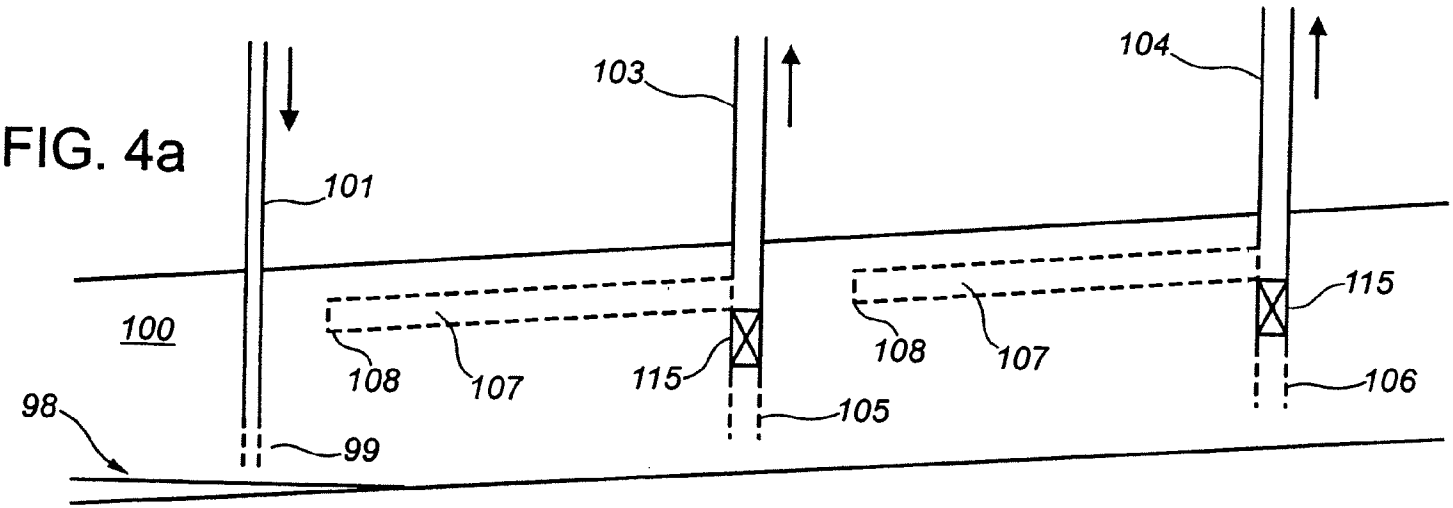
FIGS. 4*a*-4*g* represent perspective views of part of the well arrangement of FIG. 2, showing the different portions of the horizontal leg blocked at different times.
Figure 4B:
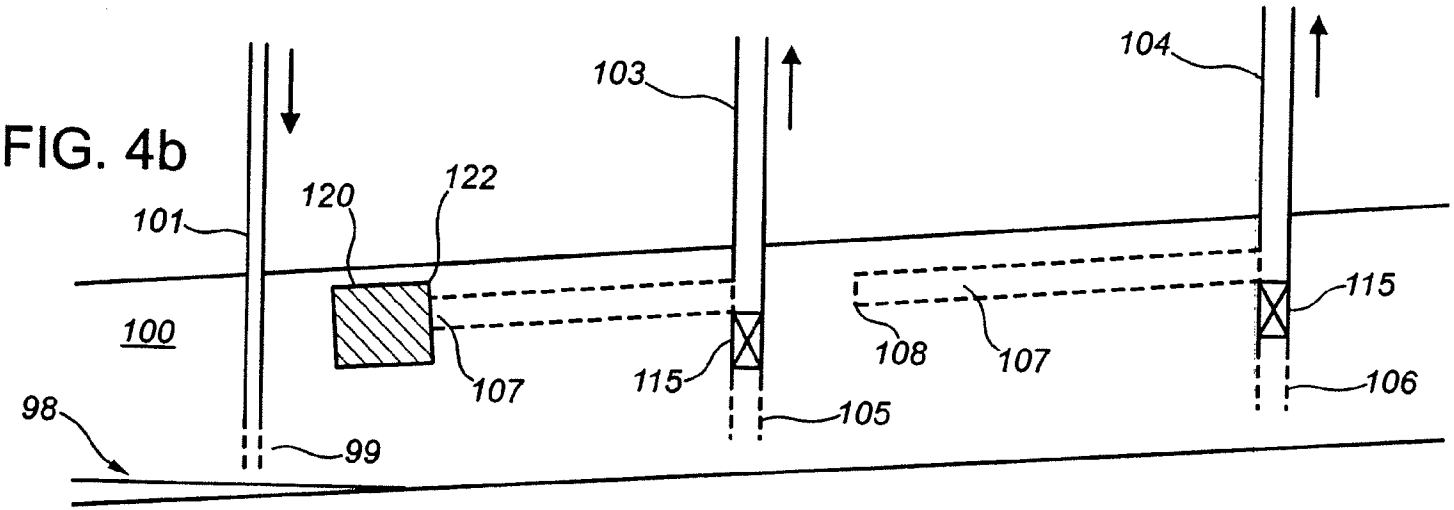

For FIGS. 2 and 4*a*-4*g*, using vertical injection wells, the oil-water contact is shown at line 98, below the completed part 99 of the vertical injection wells 101. Water is injected at all injection wells 101 and oil is produced at the horizontal legs 107 of oil production wells 103, 104, while the pilot holes 105, 106 of the production wells are closed off at 115 (below the horizontal legs). The water front advances both laterally and vertically towards the low pressure sink created by the horizontal legs of the open production wells 103, 104. The situation after 3%-4% PV of water is injected is illustrated in FIG. 4*a*. At this moment the first portion of approximately 10%-15% of the total horizontal leg 107 is to be blocked off. The situation after creation of the first blockage 120 is shown in FIG. 4*b*, in which the old producing toe portion 108 of the horizontal leg 107 is totally blocked. The main goal of the first blockage operation is to block the water coming directly to the producing toe (from the injection well).

The workover for the blockage may include the following operations and materials. During the workover, both injection and production is stopped. To this effect, bottom hole pressures are measured both in injection 101 and in production wells 103, 104. If possible, a fall-off pressure analysis is conducted on the injection well 101. This fall-off test can be continued with a bottom hole pressure monitoring for the sensing of the gel injection at the producer's toe 108.

With a coiled tubing (not shown) positioned with its far end at the edge of the producing toe region to be blocked off 122 (FIG. 4*b*), a setting gel is injected first and ideally penetrates the porous reservoir around the wellbore. The volume of gel will generally be at least 10 times the volume of casing for the portion of the toe to be blocked off. This gel volume is typically less than 20% of the start up region pore volume (the volume comprised between two vertical planes: one comprising the injection line and the other one comprising the toe of horizontal wells). Next, a robust or reinforced gel is injected to block off the wellbore, close to the toe.

Preferably, before and while injecting gel (or sandy gel) through the coiled tubing (CT), a protection fluid such as oil is injected through the annulus around the CT, with the downhole pressure of the protection fluid matching the gel pressure exiting the coil tubing. This kind of operation remains the same irrespective of the fact that the horizontal leg of the production well is open hole or has a slotted liner on that portion. In this way, no physical zonal isolation devices should be necessary.

The water injection and the oil production are started only after a sufficiently consistent gel has formed in the blocked portion 120. A slightly lower or the same injection rate as before the workover is then adopted for the injector well 101, to achieve production at the new producing toe portion of the horizontal leg (i.e., the open portion next to the blockage).

Figure 4C:
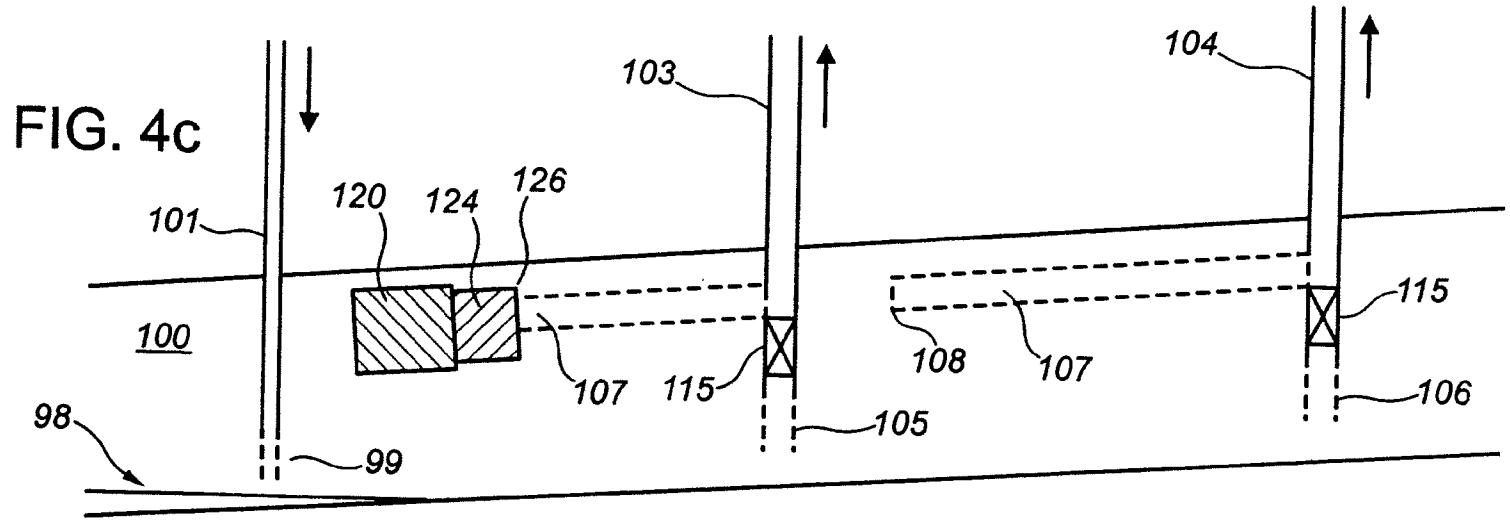

A second blocking operation as shown in FIG. 4*c* proceed as follows, once the new producing toe portion of the horizontal leg is ready for progressive blockage. A second blockage 124 is provided through the CT with the end of the CT being positioned at 126 (FIG. 4*c*). This second blockage 124 may be performed once 12%-15% PV of cumulative water has been injected. At this time, some 25%-30% of the horizontal leg can be blocked off (FIG. 4*c*). The operation is similar to that described above but the volume of gel injected may be only 6-7 times the volume of casing for the portion to be blocked off.

Figure 4D:
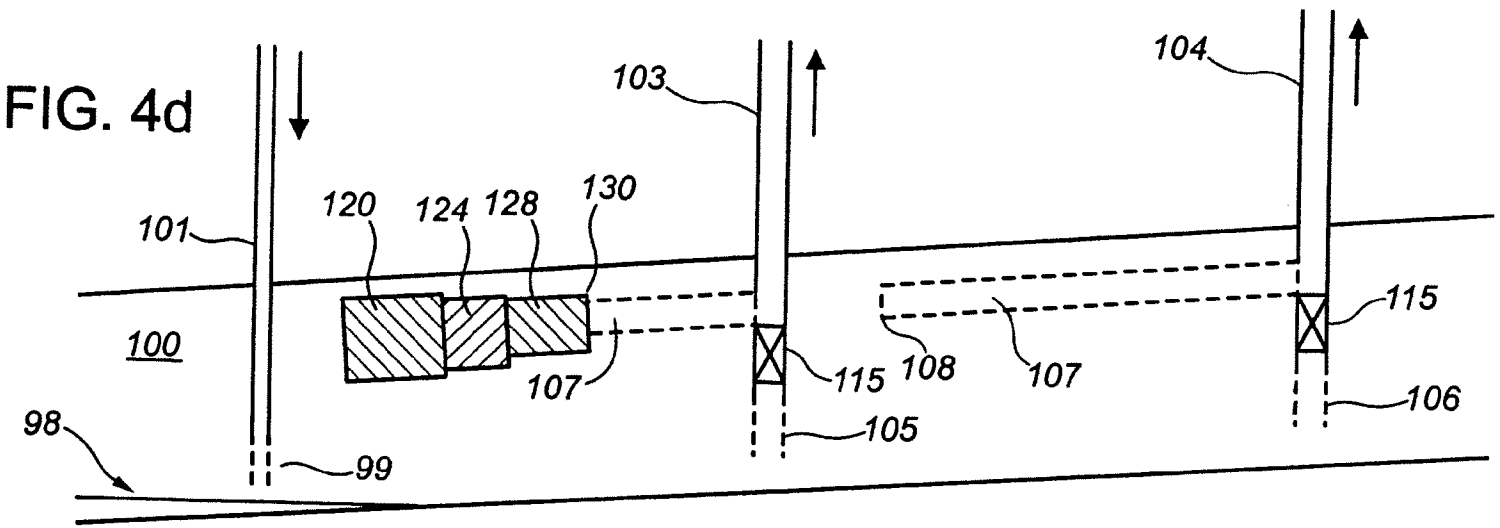

A third blockage 128 with the CT end positioned at 130 (FIG. 4*d*) can be performed once 25%-30% PV of cumulative water is injected. At this time some 40%-50% of the horizontal leg is blocked off (FIG. 4*d*). The operation is similar to that described above but the volume of gel injected may be only 3-4 times the volume of casing for the portion to be blocked off.

Figure 4E:
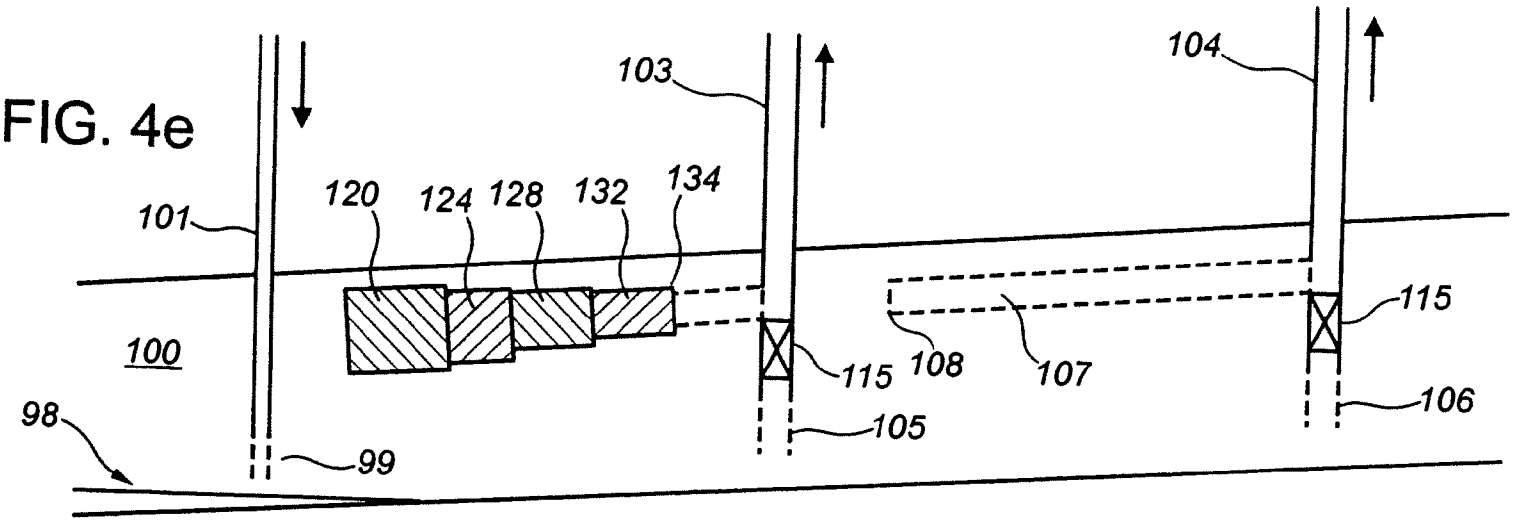

A fourth blockage 132 with the CT end positioned at 134 (FIG. 4*e*) can be performed when 80%-100% PV of cumulative water is injected. At this time some 70%-75% of the horizontal leg is blocked off (FIG. 4*e*). The operation is similar to that described above but the volume of gel injected may be only 2-3 times the volume of casing for the portion to be blocked off.

Figure 4F:
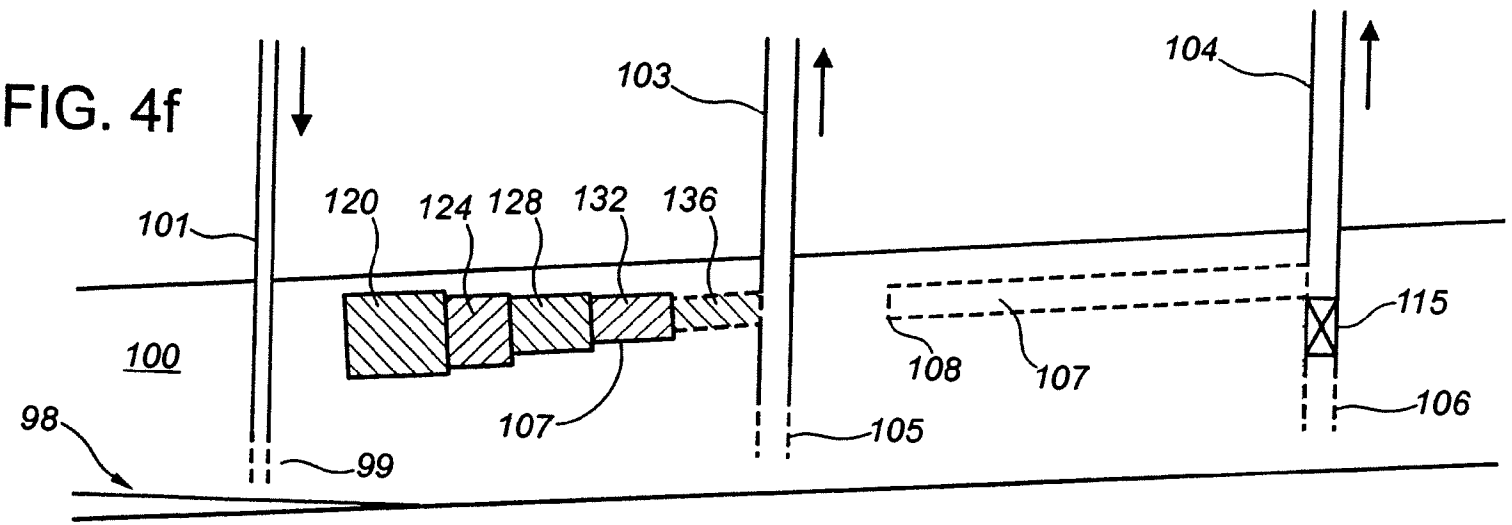
Figure 4G:
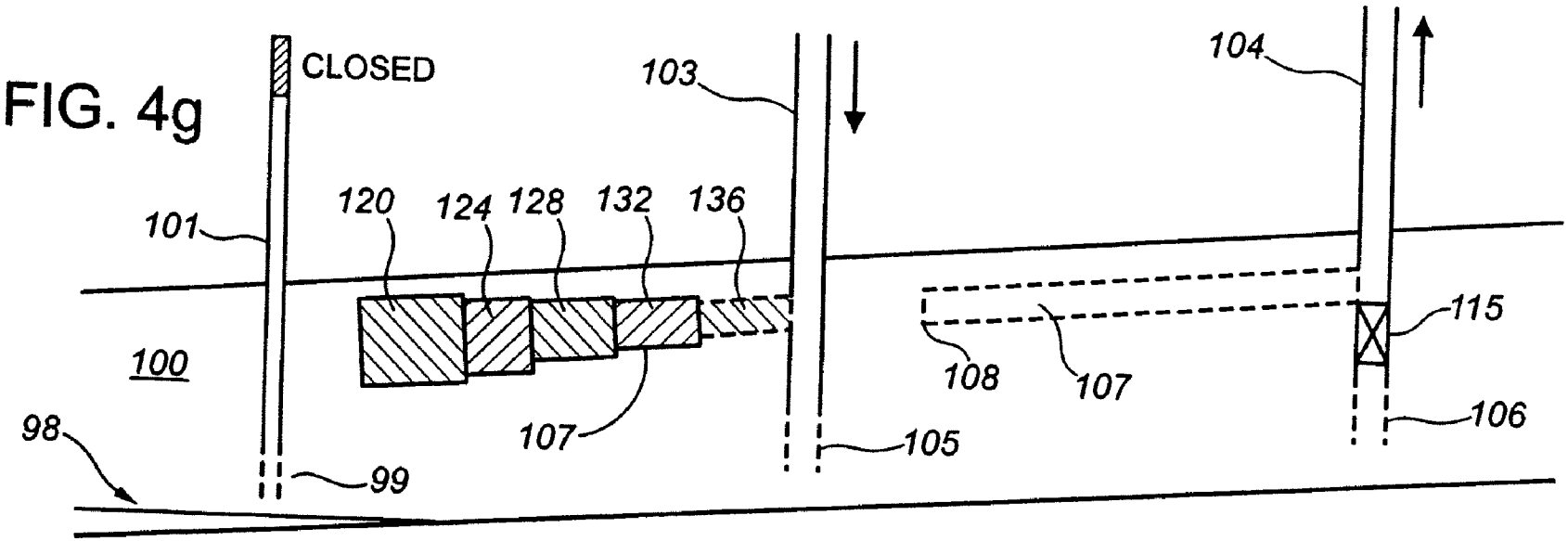

When the water cut in the production stream is over 95%, the last portion 136 of horizontal well is blocked off and the pilot hole 105 is open for production (FIG. 4*f*). When the water cut in the production stream of pilot hole is over 95%, the vertical injection well 101 is shut-in and the pilot hole 105 may be converted to water injection, while the horizontal production well from the next row 104 may be opened for production (FIG. 4*g*). The blocking off of the horizontal legs 107 for the second row of production wells 104 may follow the same pattern as for the first row, described above.

Similar procedures of progressive blockage of horizontal legs of production wells may be applied when horizontal injection wells are used for the initiation of the process (FIG. 3) instead of the vertical injection wells 101 of FIGS. 2 and 4*a*-4*g*. More particularly, with reference to FIG. 3, the opposed dual horizontal injection wells 140 may arranged in an "L" shaped configuration vis-a-vis the horizontal producers 103, 104, with a "common heel" at 142 where the vertical portion of the injection wells are located. To take advantage of the short-distance oil displacement feature, short horizontal injection legs can be coupled with long horizontal production legs, the length of horizontal injection legs may be 4-20 times shorter than that of horizontal production legs. The horizontal leg of the injection well is located at the lower part of the reservoir. At a certain amount of cumulative water injected, the toe portions of the production wells to be blocked may be slightly different than those for the case of vertical injection wells.

The invention is further supported through the following non-limiting experimental work and simulations, in which Example 1 provides actual test data from test runs in a 3D laboratory cell model containing a porous medium saturated with oil and irreductible water saturation, and Example 2 provides numerical simulation details for oil field situations. While Example 1 included a mechanical blocking agent to simulate a chemical blockage, it is to be understood that the process of the present invention includes the use of chemical blocking agents, put in place as described above.

EXAMPLE 1

Test Cell

Figure 5:
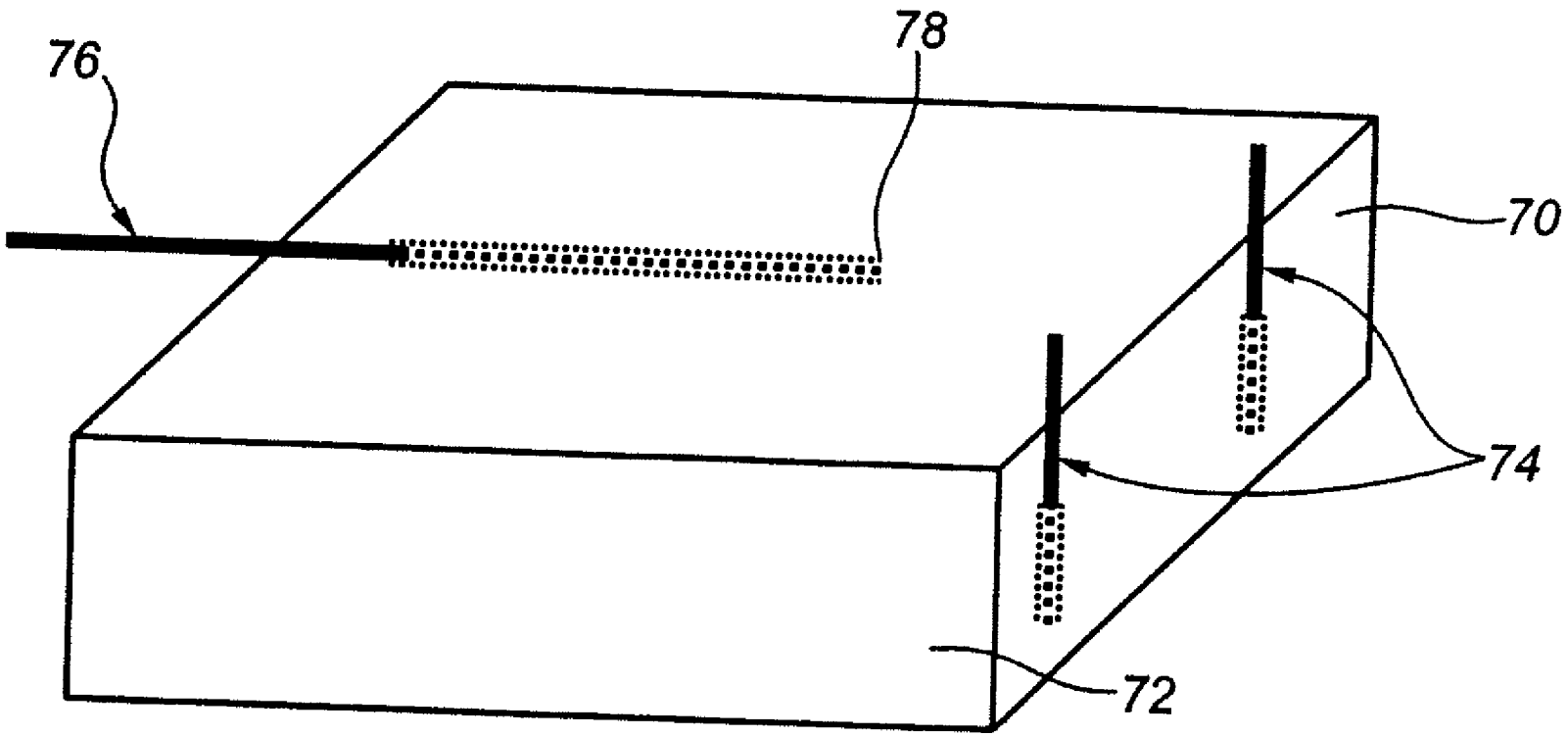
FIG. 5 is a schematic of the 3D laboratory cell used in the experimental work of Example 1, comprising two vertical injectors and one horizontal producer in a staggered line drive.

The 3D cell depicted schematically in FIG. 5 was used to demonstrate the efficiency of the improved TTHW process when applied with progressive blockage of the toe region. This cell consisted of a rectangular vessel 70 containing a porous medium 72, with two vertical injectors 74, and one horizontal producer 76 laid out in a staggered line drive configuration. The dimensions of the rectangular chamber 70 were: 38.1 cm×38.1 cm×10.8 cm; the total volume was 15.7 liters, while the pore volume was approx. 5.6 liters, at a porosity estimated at 36%.

The horizontal producer 76 was located 3 cm from the top and was perforated 24 cm. Its toe 78 was located 8 cm from the line of vertical injectors 74, which were perforated on 5.8 cm at the lower part of layer.

The horizontal producer 76 had an inside diameter of 0.120" (3.75 mm), with a cross sectional area of 0.07917 $cm^2$ (7.917 $mm^2$ ). The vertical injectors 74 had the same inside diameter. All wells are perforated with two holes on opposite sides, at approximately 1 cm intervals. The diameter of the holes is 1.8 mm.

The model was filled with glass beads, giving a water permeability of up to 4 D. The oil effective permeability at connate water saturation was up to 1.2-1.3 D. The vertical permeability was assumed equal to horizontal permeability. The brine for injection had a salinity of 23% NaCl and a density of 1.17 $g/cm^3$. The experimental investigation of TTHW process was carried out using an oil with a viscosity of 780 mPa.s and a density of 883 kg/m$^3$.

The preparation of the model before the TTHW was started included several steps:

1. Blocking of the horizontal well with a rod 80 of 0.116" (2.95 mm).

2. Positioning the model in a vertical position, i.e. with the blocked horizontal producer 76 in a vertical position, in order to avoid channeling during different saturation phases.

3. Saturation of the model with water (vertical, upwards flow), and determination of the pore volume.

4. Displacement of water using a vertical downward displacement with the oil of interest; the horizontal producer 76 remaining blocked at this stage.

5. Next, the model was positioned in the normal position and a straight simultaneous water injection in both vertical injectors 74 was conducted. In both tests, the injection rate was maintained at 0.8 ml/min.

In principle, both tests were conducted using the following procedure:

1. Water was injected through both vertical injectors 74, splitting the injection rate 50%/50% between the two wells; the rate was measured for each well.

2. Oil was produced at balance (injection rate=production rate), while the pressure in the horizontal producer 76 was maintained close to 752 kPa (109 psi).

The tests were discontinued when the water cut exceeded 93%. Two tests were performed, as follows:

Test #1: A TTHW reference test (with no toe-region blockage).

Test #2: A TTHW test in which increasing portions of the toe regions were completely blocked.

Once a test was finished, the initial condition of the model was restored by injecting oil to displace the water from the model; the oil displacement was conducted vertically downwards, at a very low rate through special ports. The main properties of the porous media and the operating parameters are included in Table 1 (OOIP means original oil in place).

In Test #2 the progressive blockage of the toe region 78 took place. This blockage was made with a rod 0.116" (2.95 mm), by introducing the rod through the toe end of the horizontal producer. Therefore, only the blockage of the toe portion of the borehole occurred; no blockage was created in the near well region. The water injection operation in the vertical injectors was not stopped during the introduction of the obstructing rod at different length within the horizontal section of the horizontal producer. The progressive blockage was made according to the following schedule:

1. First blockage: The first 3.6 cm (15% of the horizontal leg length) near the toe, at the moment when 0.03 PV of cumulative water was injected.

2. Second blockage: an additional 3.6 cm, adjacent to the first blocked region, for a total blocked region of 7.2 cm (30% of the horizontal leg length) near the toe, at the moment when 0.15 PV of cumulative water was injected.

3. Third blockage: an additional 4.8 cm, adjacent to the previous blocked regions, for a total of 12 cm (50% of the horizontal leg length) near the toe, at the moment when 0.3 PV of cumulative water was injected.

4. Fourth blockage: an additional 6 cm, adjacent to the previous blocked regions, for a total of 18 cm (75% of the horizontal leg length) near the toe, at the moment when 1.2 PV of cumulative water was injected.

TABLE 1

Properties of the porous media and operational parameters for TTHW tests

| Test # | Type of Waterflooding | Porosity % | Pore Volume L | Connate Water Sat'n % | OOIP ml | Effective Permeability to Oil, D |
|---|---|---|---|---|---|---|
| 1 | Reference | 36.4 | 5.89 | 7.7 | 5444 | 1.2 |
| 2 | Toe Blocking | 36.4 | 5.89 | 8.6 | 5389 | 1.3 |

Figure 6A:
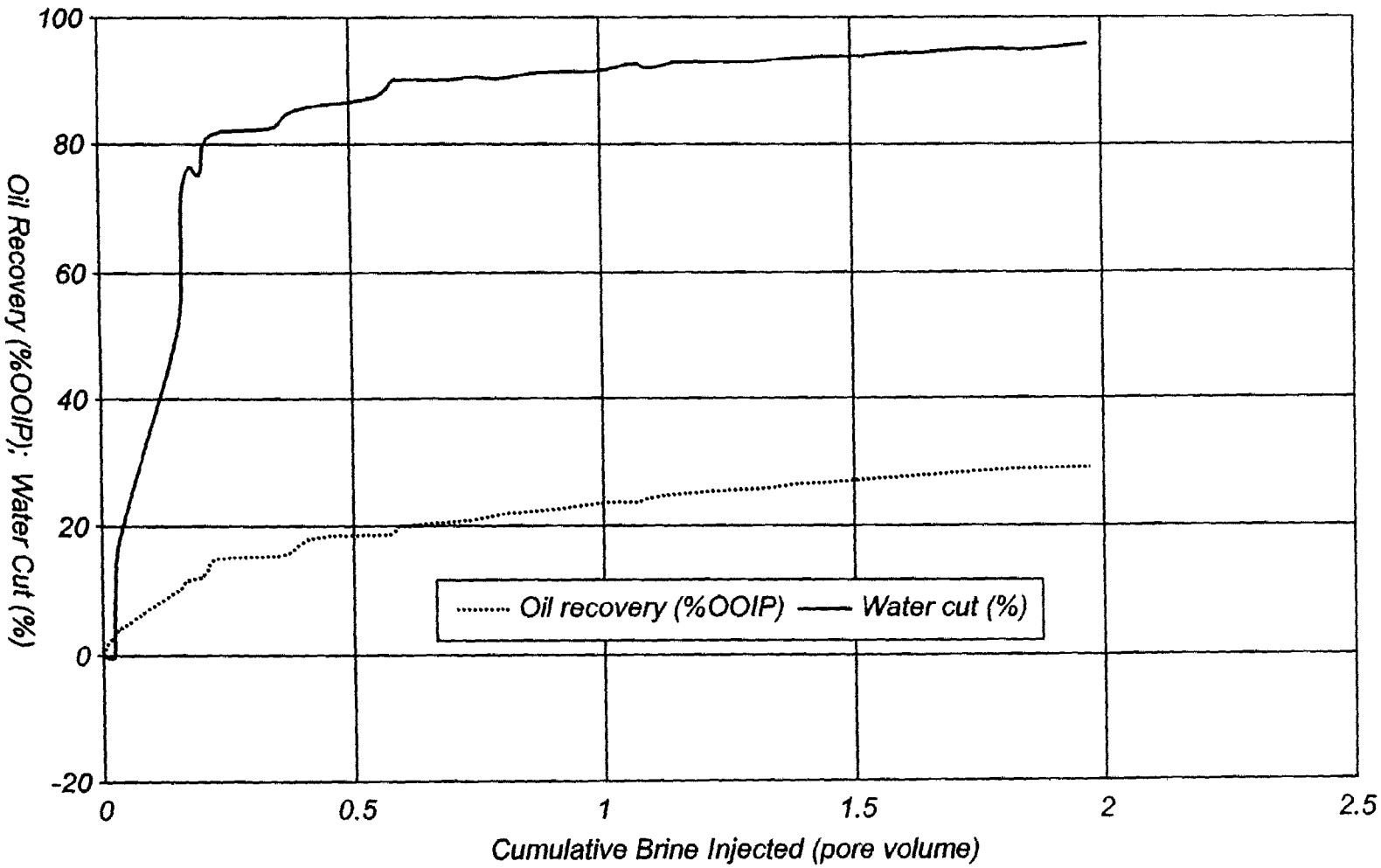
FIG. 6*a* is a graph showing the oil recovery and the water cut variation versus cumulative water injected for the normal TTHW test #1 of Example 1, carried out in the 3D laboratory cell.

In the following, the main details and results for each test are provided. Test #1: The performance of this reference test is shown in FIG. 6*a*. It can be seen that there are three distinct periods, as far as the variation of oil recovery and water cut are concerned. At the beginning, in the first period, the injection of the first 0.2 PV of water led to an oil recovery of 14%; the oil recovery curve has the highest slope. In this period, the water cut increased steeply up to 77%. In the second period, the slope of oil recovery curve is smaller. The second period lasts until 0.6 PV water is injected (from 0.2 PV to 0.6 PV) and while the oil recovery increases up to 20% OOIP, the water cut climbs to 84%. During the third period there is a small increase in oil recovery, from 20% OOIP to 29% OOIP, while 1.36 PV (from 0.6 PV to 1.96 PV) of water is injected. The final water cut is approximately 96%. In this last period, the water cut and oil recovery curves are almost parallel, indicating that the same relatively inefficient mechanism is predominant for the entire period. Continuing the exploitation, more oil can be recovered at the last value of the water-oil ratio (53 m$^3$/m$^3$), which seems to be constant throughout this period. For the whole test, the cumulative injected water-produced oil ratio was 7.6 m$^3$/m$^3$.

In the first part, the injection pressure was about 786 kPa (114 psi). Then, injection pressure decreased continuously to 731-768 kPa (106-110 psi), towards the end of the test. The differential pressure injection-production was around 34-41 kPa (5-6 psi), at the beginning, and then decreased to around 21 kPa (3 psi), towards the end of the test.

Figure 6B:
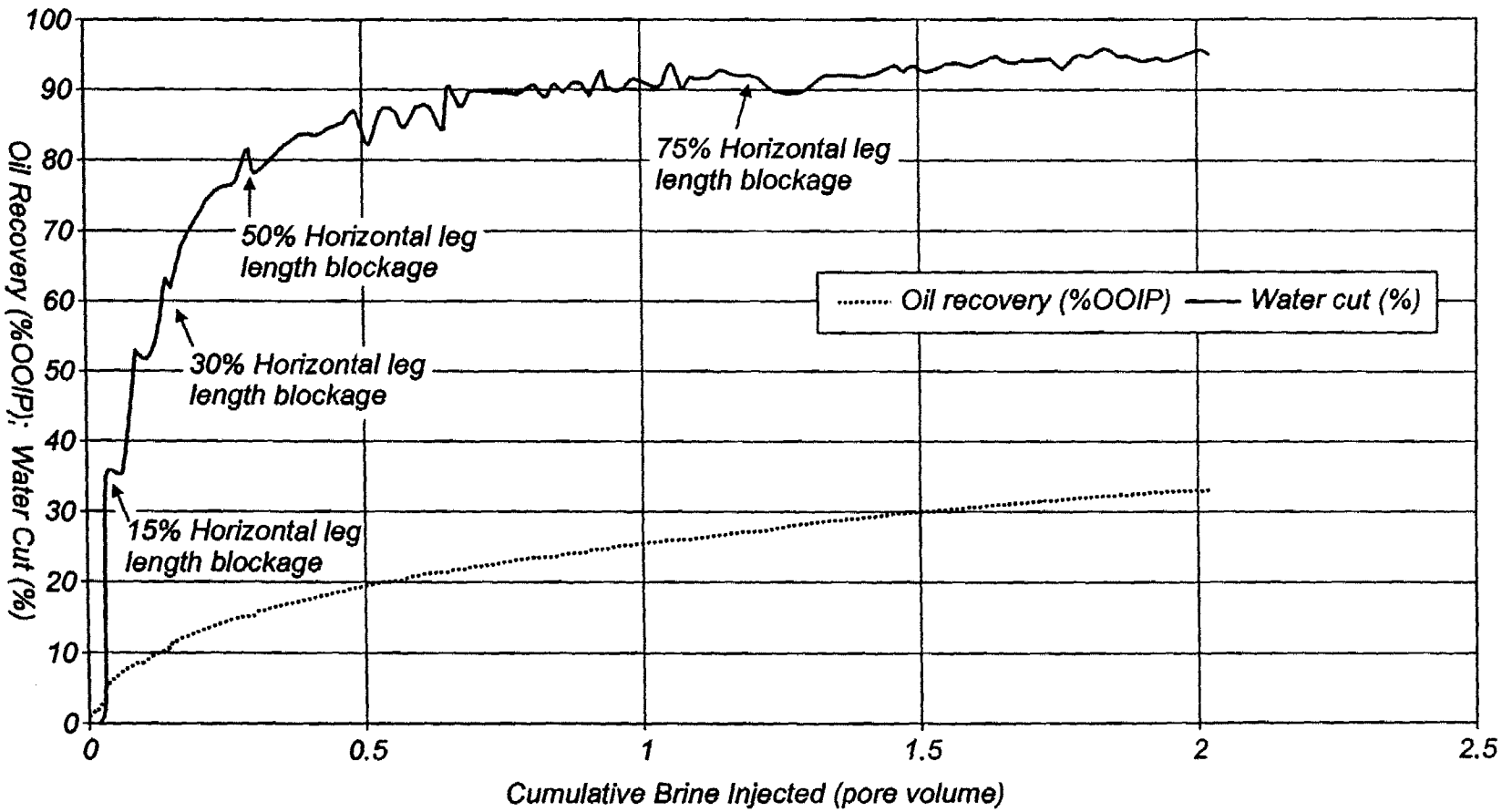
FIG. 6*b* is a graph showing the oil recovery and the water cut variation versus cumulative water injected for the TTHW test #2 of Example 1 with progressive blockage of the toe region, carried out in the 3D laboratory cell.

Test #2: The performance of this TTHW optimization test is shown in FIG. 6*b*. It is no longer possible to distinguish three production periods, as far as the variation of oil recovery and water cut are concerned. Compared to Test #1, the following differences can be noticed:

At 0.2 PV water injected, the water cut is only 70%, as compared to 77% in Test #1; oil recovery is almost identical in both tests.

At 0.6 PV water injected, the water cut is 87%, as compared to 84% in Test #1; however the oil recovery is 21% OOIP, as compared to 20% OOIP in Test #1.

At the completion of the tests, at 1.96 PV water injected, the oil recovery is 33% OOIP, as compared to 29% OOIP, in Test #1. The incremental oil recovery of 4% OOIP is almost double what was obtained in the field simulations described below in Example 2. However, the comparison is not entirely rigorous as the blockages were not identical to those "operated", and the oil and rock properties are slightly different in the simulation. Although not entirely rigorous, this comparison shows that some beneficial recovery mechanisms are not actually taken into account in the mathematical model upon which the simulation is based.

Unlike the Test #1, the variation of the water cut undergoes a series of fluctuations, principally in the last period when the water cut is higher than 83%. For the whole test, the injected water-produced oil ratio was 6.5 $m^3/m^3$, while for the last period, before the completion of the waterflood, this ratio was 37 $m^3/m^3$.

Initially, the injection pressure was about 821 kPa (119 psi). Injection pressure then decreased continuously to 779-821 kPa (113-119 psi) after the first blockage, 724-793 kPa (105-115 psi) after the second blockage, and then decreased to a steady value of 703-745 kPa (102-108 psi). Initially, the production pressure was around 814 kPa (118 psi). Production pressure then decreased continuously to 793 kPa (115 psi) after the first blockage, 786 kPa (114 psi) after the second blockage, and then decreased to a steady value of 717 kPa (104 psi). As it can be noticed, the initial differential pressure injection-production was around 28-34 kPa (4-5 psi), and then decreased to around 14 kPa (2 psi) towards the end of the test.

Overall, the improvement of the performance of TTHW process by progressive blockage of the toe region may be illustrated by the observation that the water injected-produced oil ratio was decreased 14% (from 7.6 $m^3/m^3$ to 6.5 $m^3/m^3$), while the oil recovery factor increased with 4% OOIP.

EXAMPLE 2

Simulations

The improvement of the performance of TTHW process by progressive blockage of the toe region was confirmed by numerical simulation studies using discretized wellbore in a commercial simulation package. For the study of the reservoir behaviour, the wellbore was treated as an ensemble of segments or grid blocks, and the reservoir flow equations are coupled with the ensuing flow inside each of these segments.

The discretized wellbore model is a fully coupled mechanistic wellbore model. It models the fluid flow between the wellbore and the reservoir. The wellbore mass conservation equations are solved together with reservoir equations for each wellbore segment. Two correlations are used to calculate the friction pressure drop and liquid holdup gas-liquid in the wellbore. Bankoff's correlation is used to evaluate the liquid holdup and Duckler's correlation is used to calculate the friction pressure drop. The oil-water mixture is considered as a homogeneous liquid with respect to which gas slippage is calculated under three phase flow conditions. The viscosity of the liquid is determined from the oil and water phase viscosities using an empirical mixing-rule based on their respective saturations and velocities.

The main objective of simulation was to maximize oil recovery during the TTHW by progressive blockage of the horizontal leg in the toe region.

Figure 7A:
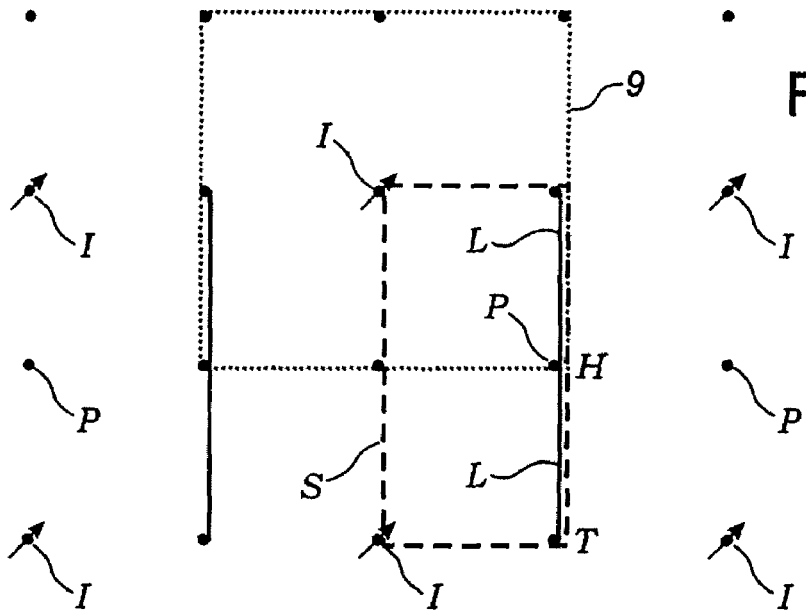
FIG. 7*a* is a schematic showing the well configuration for a field scale simulation as described in Example 2 in which conversion of an inverted nine-spot conventional waterflooding pattern into a line drive TTHW operation using opposed dual lateral horizontal wells is used.
Figure 7B:
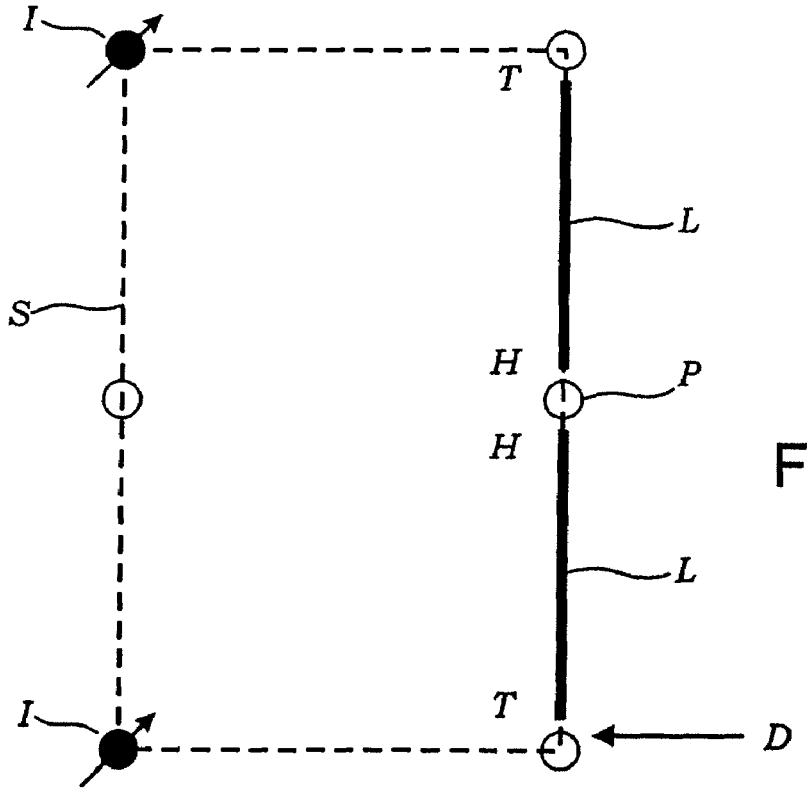
FIG. 7*b* is a schematic showing the simulation region of FIG. 7*a* in dotted outline for the numerical modeling of TTHW as set forth in Example 2.

The reservoir model is an element of symmetry from a nine-spot pattern 9 (FIG. 7*a* shows the TTHW well configuration for the field scale simulations in which an inverted nine spot conventional waterflood pattern (402 m between producers P and vertical injectors 1) is converted to a line drive TTHW using opposed dual lateral horizontal legs L of production wells with heels marked H and toes marked T. The simulation area S is shown in the smaller dotted outline in FIG. 7*a*, and again in FIG. 7*b*.). It consists of 29×51×8 grid cells and has a uniform lateral permeability of 1200 md and uniform vertical permeability of 600 md. The horizontal well is located in the $29^{th}$ x-direction cell in the topmost layer as an opposed dual lateral—each lateral having a length of 400 m. As shown in FIG. 7*b* the laterals have a "common" heel (H), whereas the toes (T) are close to northern and southern ends. The perpendicular distance between the toe of the lateral to the line joining the two injectors is defined as toe-offset distance D. In the element of symmetry shown in FIG. 7*b* a line joins one injector with the immediate neighbouring injector. In other words, the former injectors of the adjacent nine-spot patterns become the new injectors for the two opposed dual laterals located at the periphery of the former nine-spot patterns.

The reservoir fluid consists of live oil and connate water. The saturation pressure is very close to the initial reservoir pressure. The reservoir properties used in the simulation are given below.

Basic Parameters Used in the Simulation:

Grids 29×51×8

Horizontal permeability, md 1200; Vertical permeability, md 600

Porosity, % 30

Initial reservoir pressure, kPa 4600

Reservoir temperature, ° C. 24

Bubble point pressure, kPa 4570

Initial solution GOR (Gas Oil Ratio), $m^3/m^3$ 15.5

Viscosity of reservoir oil at the Bubble point pressure, cp 130

Rock compressibility, $[kPa]^{-1}$ 6.6E-07

Connate water saturation, fraction 0.24

Residual oil saturation, $S_{or}$, fraction 0.40

Critical gas saturation, fraction 0.05

Relative permeability to water at $S_{or}$ 0.10

Horizontal wellbore diameter 2.5" (6.25 cm)

Relative roughness factor 0.01.

A study of pressure, water cut, and GOR behaviour along the horizontal wellbore brought forth certain interesting aspects of the toe-to-heel waterflooding that can be optimized to obtain maximum benefits from the process. These issues relate to workover operation(s) for blocking of the toe region producing excessive water, and appropriate value of the toe-offset distance as compared to the length of horizontal section.

To address these aspects, optimization runs for the generic model were made, taking as reference the TTHW base case in which no toe region blockage is operated. The details of these runs and their results are presented in Table 2. In the base case the toe to injection line distance is zero, as seen in FIG. 7*a*. The TTHW base case involved the running of the TTHW process for 40 years, which led to an oil recovery of 42.9%.

From Table 2, it can be seen than by having a toe-offset distance of about 60 m, and blocking the first 40 m from the toe in a workover operation planned after one year of TTHW (Case 5) can provide additional oil production of over 10,000 $m^3$, corresponding to an increase in oil recovery from 42.9% to 44.4%. It should be mentioned, that although not directly comparable, the laboratory results of Example 1 shows better results than those from simulation, as from the laboratory test, an incremental oil recovery of 4% OOIP resulted.

TABLE 2

Typical optimization scenarios for TTHW
(OOIP in the pattern = 702,000 $m^3$; horizontal well length = 400 m)

| Case | Toe offset (m) | Details | # Workover Jobs for Blockage | Recovery (% OOIP) | Add'l Oil Recovered $m^3$ |
|---|---|---|---|---|---|
| Base | 0 | TTHW, no blockage | 0 | 42.90 | 0 |
| 1 | 0 | Block 60 m after 6 mon. | 1 | 43.31 | 2879 |
| 2 | 0 | As 1, then block another 100 m after 1 yr | 2 | 44.37 | 10430 |
| 3 | 0 | Block 60 m after 1 yr, Another 40 m after 5 yrs | 3 | 44.26 | 9681 |
| 4 | 0 | Block 100 m after 5 yrs, Another 100 m after 10 yrs, Another 100 m after 20 yrs | 3 | 43.12 | 1559 |
| 5 | 60 | Block 40 m after 1 yr | 1 | 44.36 | 10425 |

Although the experimental section above describes using a gel for blockage, the blockage can be made with other chemical blocking agents known to those skilled in the art, such as, but without limitation, cement and resins. In a different TTHW laboratory experiment not described here, the entire length of the horizontal section of the horizontal production well was blocked with an oil resistant resin (slow set epoxy resin) which was pumped at the heel region using an extremely low flow rate; a volume of resin three times the volume to be blocked was used. Prior testing outside porous media had shown that a low flow rate and associated low differential pressure would ensure wellbore filling before the extrusion through the perforations. This was confirmed after the test once the model was dismantled and the toe section of the well was cross-sectioned lengthwise. It was observed that not only was the bore fully plugged, but also that the extruded resin had fully encapsulated the horizontal section tubing.

For field operation, both for vertical injection wells and for short horizontal injection wells, numerical simulation provides the best data for timing of the blockage operations, the cumulative water injected prior to placing the blockage, and the length of horizontal leg to be blocked off at each operation. The numerical simulation can take into account the detailed variation of vertical and horizontal permeability, providing an exact volumetric configuration of the region invaded by water.

The examples given above are illustrative; and based on the experience from laboratory tests. These examples should not limit the variation of the process of this invention by those skilled in the art.

All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention. One of ordinary skill in the art will appreciate that elements and materials other than those specifically exemplified can be employed in the practice of the invention without resort to undue experimentation. All art-known functional equivalents, of any such elements and materials are intended to be included in this invention. The invention illustratively described herein suitably may be practiced in the absence of any element or elements, limitation or limitations which is not specifically disclosed herein.

As used herein, "comprising" is synonymous with "including," "containing," or "characterized by," is inclusive or open-ended, and does not exclude unrecited elements. The use of the indefinite article "a" in the claims before an element means that one or more of the elements is specified, but does not specifically exclude others of the elements being present, unless the contrary clearly requires that there be one and only one of the elements.

We claim:

1. A process for recovering oil from a reservoir in an underground formation, comprising:

a) providing a vertical injection well completed in the lower part of the reservoir or a horizontal injection well located and completed in the lower part of the reservoir, and a production well having a generally vertical pilot portion and a generally horizontal leg which is completed relatively high in the reservoir and oriented toward the completed part of the injection well;

b) injecting a liquid heavier than oil into the reservoir through the injection well to establish a body of said liquid low in the reservoir and underlying the horizontal leg of the production well;

c) continuing to inject liquid with the production well open, so that oil is produced through the horizontal leg, and the leg creates a low pressure sink which causes a displacement front to advance either or both laterally and upwardly through the reservoir toward the horizontal leg of the production well, thereby driving oil through the horizontal leg of the production well, the open portion of the horizontal leg at which most of the production takes place being termed the producing toe portion of the horizontal leg;

d) after a time, placing a chemical blocking agent at the producing toe portion of the horizontal leg of the production well to create a blockage in the producing toe portion and to create a new producing toe portion in an open portion of the horizontal leg adjacent to the blockage, through which production may take place;

e) continuing production through the new producing toe portion and the open portion of the horizontal leg of the production well; and f) optionally repeating steps d) and e) to progressively block producing toe portions in a direction toward the pilot portion of the production well.

2. The process as set forth in claim 1, wherein steps d), e) and f) include:

i) shutting in the production well;

ii) providing coil tubing through the production well to reach the producing toe portion to be blocked;

iii) optionally injecting a protection fluid into an annulus formed in the horizontal leg around the coil tubing in an area not to be blocked;

iv) injecting a chemical blocking agent through the coil tubing in a volume greater than that needed to fill the producing toe portion to be blocked;

v) removing the coil tubing and allowing the chemical blocking agent to set to create the blockage in the producing toe portion; and vi) resuming production at the new producing toe portion and the open portion of horizontal leg of the production well.

3. The process as set forth in claim 2, wherein the chemical blocking agent is a gel which can be injected by coil tubing for setting in the reservoir.

4. The process as set forth in claim 3, which further comprises, after injecting the chemical blocking agent, injecting a more robust chemical blocking agent into the producing toe portion to be blocked, thereby pushing the chemical blocking agent into the reservoir surrounding the producing toe portion to be blocked.

5. The process as set forth in claim 4, wherein the more robust chemical blocking agent is a sandy gel material.

6. The process as set forth in claim 5, wherein the protection fluid is used and is a viscous oil.

7. The process as set forth in claim 6, wherein the reservoir is a heavy oil containing reservoir.

8. The process as set forth in claim 7, wherein the liquid which is heavier than oil is water or brine.

9. The process as set forth in claim 8, wherein:

a plurality of injection wells, arranged in a row are provided;

a plurality of production wells, each with a horizontal leg, are provided, arranged in a row which is parallel to the row of injection wells, the production wells also being arranged in a staggered line drive configuration relative to the injection wells, with the toe portions of each of the horizontal legs being close to, but spaced from, the completed portion of at least one of the injection wells; and the displacement front formed is of a line drive type.

10. The process as set forth in claim 3, wherein the protection fluid is used and is a viscous oil.

11. The process as set forth in claim 10, wherein the reservoir is a heavy oil containing reservoir.

12. The process as set forth in claim 11, wherein the liquid which is heavier than oil is water or brine.

13. The process as set forth in claim 12, wherein:

a plurality of injection wells, arranged in a row are provided;

a plurality of production wells, each with a horizontal leg, are provided, arranged in a row which is parallel to the row of injection wells, the production wells also being arranged in a staggered line drive configuration relative to the injection wells, with the toe portions of each of the horizontal legs being close to, but spaced from, the completed portion of at least one of the injection wells; and the displacement front formed is of a line drive type.

* * * * *